US005836260A

United States Patent [19]

Kawaguchi et al.

[11] Patent Number: 5,836,260

[45] Date of Patent: Nov. 17, 1998

[54] NEEDLE BAR STOPPER FOR USE IN A SEWING MACHINE

[75] Inventors: Yasuhiko Kawaguchi, Kaizu-gun; Akio Takahashi, Hashima-gun; Masaki Shimizu, Toyoake; Minoru Sakanobe, Komaki, all of Japan

[73] Assignee: Brother Kogyo Kabushiki Kaisha, Nagoya, Japan

[21] Appl. No.: 899,791

[22] Filed: Jul. 24, 1997

[30] Foreign Application Priority Data

Nov. 20, 1996 [JP] Japan ..... 8-309572

[51] Int. Cl.[6] ..... D05B 69/18

[52] U.S. Cl. ..... 112/277; 112/221

[58] Field of Search ..... 112/275, 277, 112/273, 271, 274, 445, 221

[56] References Cited

U.S. PATENT DOCUMENTS 4,173,193 11/1979 Morinaga et al. ..... 112/273

4,343,256 8/1982 Neuweiler et al. ..... 112/275

5,265,026 11/1993 Nishizawa ..... 112/277 X 5,458,075 10/1995 Tice et al. ..... 112/275 X

*Primary Examiner*—Peter Nerbun

*Attorney, Agent, or Firm*—Oliff & Berridge, PLC

[57] ABSTRACT

A needle bar stopper is provided in a sewing machine having a main shaft and a needle bar which moves vertically upon reception of a driving force from the main shaft. The needle bar stopper comprises a transmission prohibiting unit, including a needle bar stopping solenoid, which prohibits transmission of the driving force from the main shaft to the needle bar and a braking unit, including a needle bar stopping solenoid, which applies a braking force to the needle bar when transmission of the driving force is prohibited by the transmission prohibiting unit. The needle bar stopper can stop the needle bar reliably by use of the braking unit.

18 Claims, 8 Drawing Sheets

NEEDLE BAR STOPPER FOR USE IN A SEWING MACHINE

BACKGROUND OF THE INVENTION

1. Field of the Invention

This invention relates to a needle bar stopper for use in a sewing machine having a main shaft and a needle bar which moves vertically upon reception of a driving force from the main shaft.

2. Description of the Related Art

In embroidery machines recently proposed in the field of embroidery machines, a needle bar case containing a number of needle bars arrayed side by side is provided at a head. The needle bars are selected one by one sequentially and vertically moved to stitch a multi-color embroidery pattern. In embroidery machines of this kind, the needle bar to which a driving force is transmitted from a main shaft is replaced by stopping the needle bar at its upper dead point and by sliding the needle bar case. It is common practice in the field of embroidery machines to stop the needle bar, even if it is only one needle bar, near its upper dead point when a thread breakage occurs or when needle bar jump is performed.

In addition, sewing machines recently proposed in the field of general sewing machines are provided with a main shaft motor which drives a main shaft and a separate loop-catcher drive motor which rotationally drives a loop catcher. In sewing machines of this kind, the main shaft motor and the loop-catcher drive motor are controlled to operate in synchronism with each other, and if they get out of synchronism, the needle bar may interfere with the loop catcher. To avoid this, it is preferable to stop the needle bar near its upper dead position when the above-mentioned asynchronism occurs.

As a needle bar stopper for these various sewing machines, a device having, for example, the following structure has been proposed. The device comprises a vertically movable segment which vertically moves upon reception of a driving force from the main shaft and which is also laterally swingable, and an engaging projection projecting from the vertically movable segment toward the needle bar and engageable with a linking pin of the needle bar. In order for the device to stop the needle bar, the vertically movable segment is swung by, for example, a solenoid to disengage the engaging projection from the linking pin. When such disengagement takes place, the driving force is stopped from being transmitted from the main shaft to the needle bar. In addition, the needle bar is usually urged upward by a compression spring. Accordingly, when the above disengagement takes place, the needle bar moves upward by a biasing force of the compression spring.

However, since the needle bar has certain inertia, prohibiting the transmission of the driving force to the needle bar by the above disengagement is not always enough to stop the needle bar. For example, when the above disengagement takes place while the needle bar is descending, the needle bar continues descending due to the inertia. In this case, jumping the needle bar may cause the needle bar to be caught in a material being sewn or to interfere with the loop catcher.

SUMMARY OF THE INVENTION

In view of the foregoing, an object of the invention is to provide a needle bar stopper which is used in a sewing machine and can stop a needle bar reliably.

To achieve this object, a needle bar stopper according to the invention is used in a sewing machine having a main shaft and a needle bar which moves vertically upon reception of a driving force from the main shaft. The needle bar stopper for stopping the needle bar comprises a transmission prohibiting unit which prohibits transmission of the driving force from the main shaft to the needle bar, and a braking unit which applies a braking force to the needle bar when transmission of the driving force from the main shaft to the needle bar is prohibited.

With the above structure, the transmission prohibiting unit prohibits transmission of a driving force from the main shaft to the needle bar. The braking unit applies a braking force to the needle bar when transmission of the driving force is prohibited by the transmission prohibiting unit. The needle bar is stopped reliably by not only prohibition of transmission of the driving force thereto but also application of the braking force thereto. Accordingly, the needle bar is effectively prevented from being caught in a material being sewn or from interfering with a loop catcher.

According to a preferred feature of the invention, the needle bar stopper may further comprise a moving direction detector which detects the needle bar moving direction, and the braking unit may be controlled to operate or not to operate based on a result of the detection by the moving direction detector.

Applying a braking force to the needle bar which is ascending is likely to prevent the needle bar from ascending, causing the needle bar to be caught in the material being sewn or to interfere with the loop catcher. Such trouble is effectively prevented by the needle bar stopper structured as described above, where the braking unit is controlled to operate or not to operate based on the needle bar moving direction detected by the moving direction detector, and applies a braking force while taking braking timing into account. Therefore, in the sewing machine to which the invention is applied, the needle is effectively prevented from being caught in the material being sewn or from interfering with the loop catcher.

According to another feature of the invention, the braking unit may be so arranged as to apply a braking force by pressing a member having a high friction coefficient against the needle bar.

If the above structure is employed, the needle bar can be braked reliably in quite a simple structure.

According to still another feature of the invention, the sewing machine may have a main shaft motor which rotationally drives the main shaft and a separate loop-catcher drive motor which rotationally drives the loop catcher, and the needle bar stopper may further comprise an asynchronism detector which detects asynchronism between the needle bar and the loop catcher. Additionally, the transmission prohibiting unit may be so arranged as to prohibit transmission of the driving force when the asynchronism detected by the asynchronism detector exceeds a predetermined threshold value.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
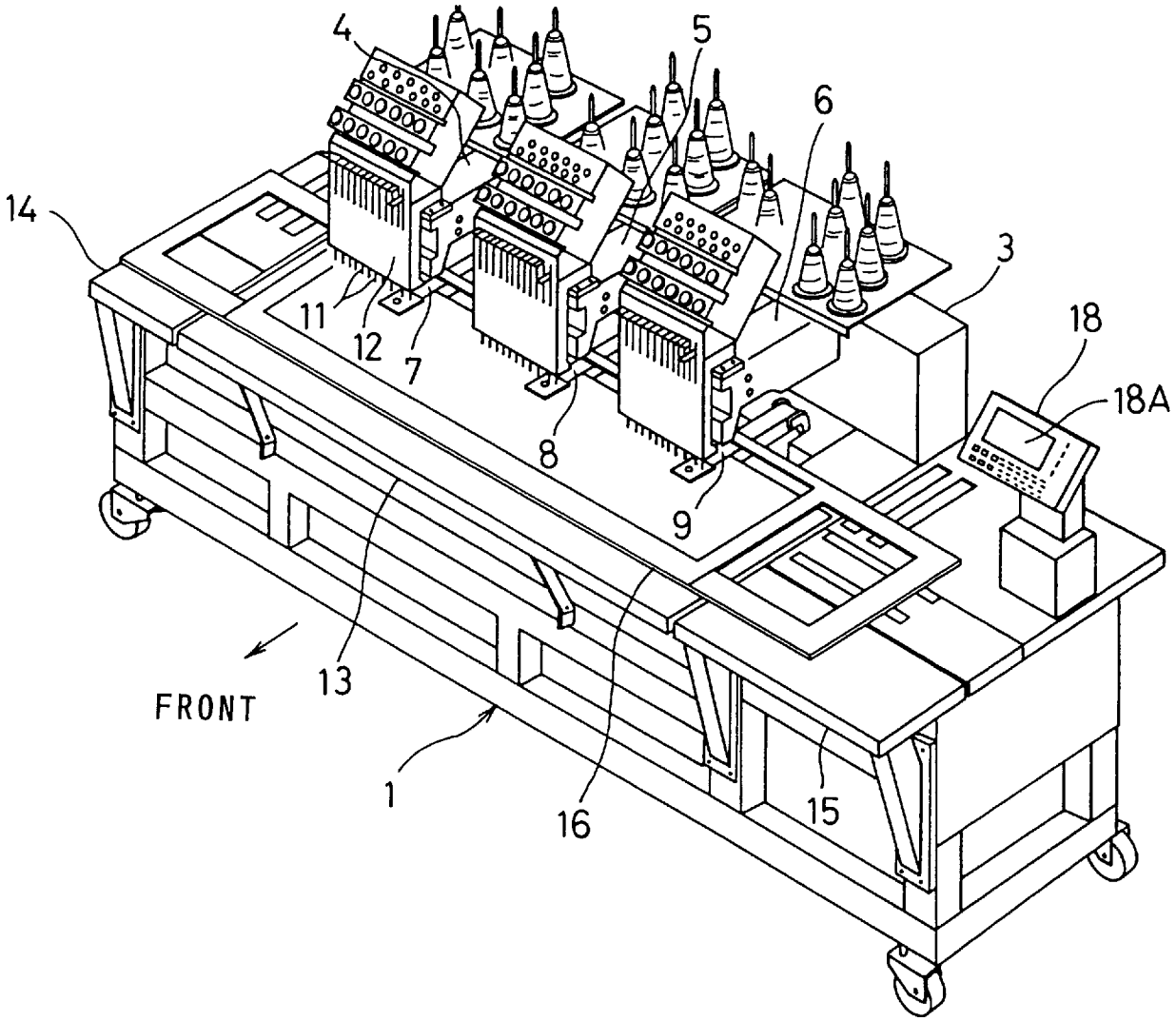
FIG. 1 is a perspective view showing a structure of an embroidery machine incorporating a needle bar stopper according to the invention.

An embroidery machine according to a preferred embodiment of the invention will be described while referring to the drawings.

FIG. 1 is a perspective view showing the structure of an embroidery machine incorporating a needle bar stopper according to the invention. The embroidery machine is a three-head embroidery machine as shown below.

As shown in FIG. 1, the embroidery machine has a laterally extending base frame 1. A laterally extending support frame 3 stands at the top rear of the base frame 1. On the support frame 3, three heads 4, 5, 6 are provided at predetermined intervals. Provided on the upper surface of the base frame 1 are beds 7, 8, 9 which respectively oppose the heads 4, 5, 6.

At the front end of each of the heads 4, 5, 6, a case 12 is laterally movably supported. Twelve needles aligned in a row are vertically movably supported in each case 12. At the top front of the base frame 1, a work table 13 is placed so that the work table is as high as the upper surfaces of the beds 7, 8, 9. A rectangular workpiece holding frame 16 is provided at the top of the work table 13 and auxiliary tables 14, 15 on both sides thereof. The workpiece holding frame 16 is so arranged as to hold a material being sewn 99 (FIG. 2) and to move in the X-axis direction (laterally) and in the Y-axis direction (forward and backward). In addition, provided at the rear of one auxiliary table 14, 15 are a display 18A which displays a message about sewing and an operation panel 18 from which various commands are executed.

Figure 2:
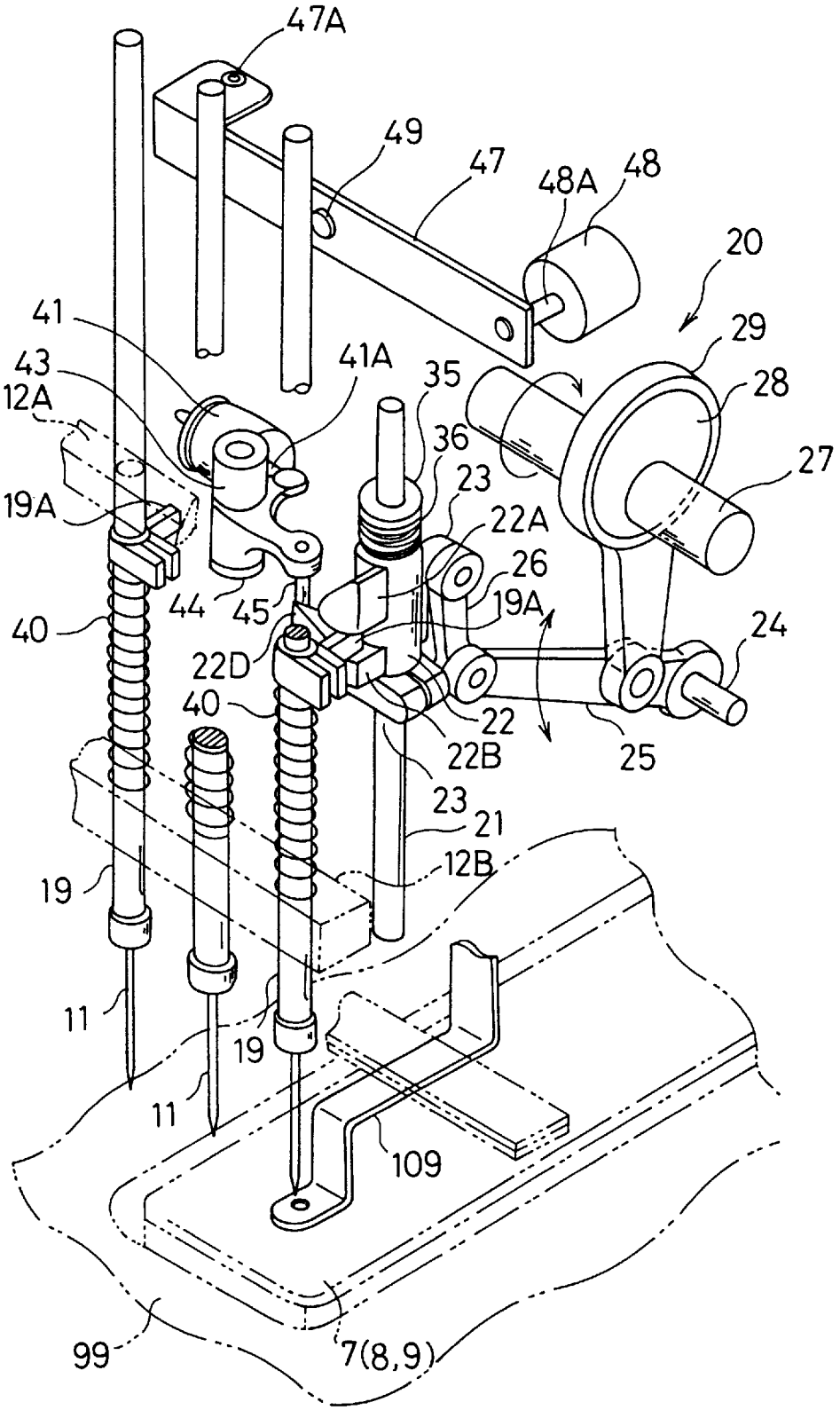
FIG. 2 is a perspective view showing a structure of a driving mechanism of the embroidery machine.
Figure 3:
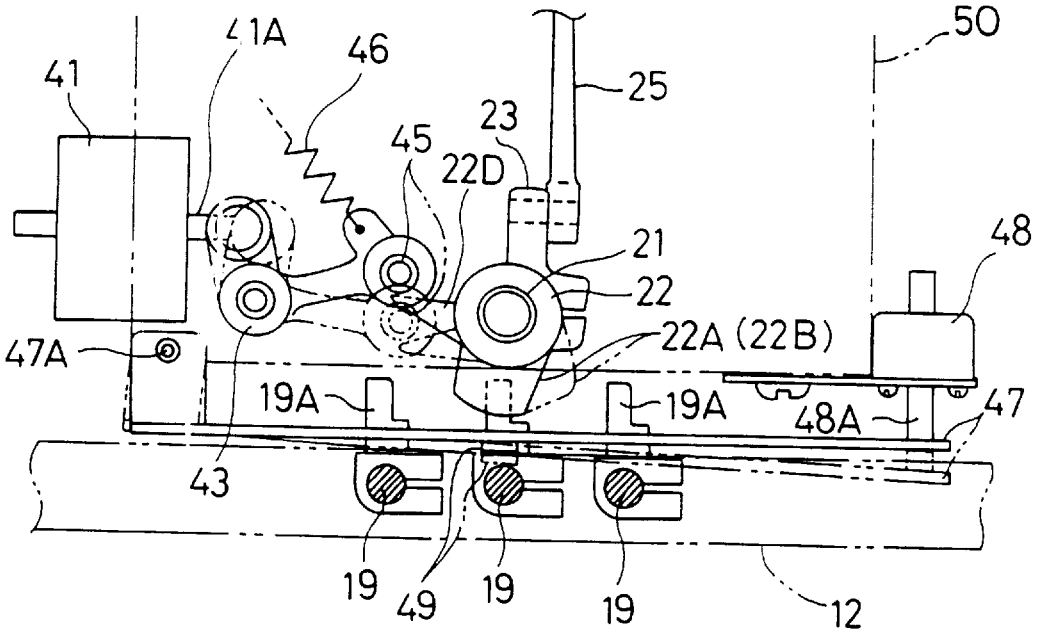
FIG. 3 is a plan view showing a structure and operation of the driving mechanism of the embroidery machine.

Referring now to FIGS. 2 and 3, described below is the structure of a driving mechanism 20 which vertically moves any one of needle bars 19. A needle 11 is attached to the lower end of each needle bar 19. A head frame 50 (FIG. 3) is attached to the tip of each head 4 to 6. The upper and lower ends of a vertically placed master needle bar 21 are fixed to the front end of each head frame 50.

At the master needle bar, a vertically movable segment 22 is vertically movably provided to vertically move any one of the needle bars 19 via a linking pin 19A which is fixed to each needle bar 19. At the lower end of the vertically movable segment 22, there is provided a driving member 23 which moves integrally with the vertically movable segment 22. The vertically movable segment 22 is provided rotatably about the master needle bar 21 with reference to the driving member 23. At the rear of the driving member 23, a swing lever 25 is provided swingably around a pivot shaft 24 which is horizontally supported within each head frame 50. One end of the swing lever 25 is connected to the driving member 23 via a link 26.

On the other hand, an eccentric cam 28 is fixed to a main shaft 27 which is provided laterally through the head frames 50 of the heads 4 to 6. The lower end of an eccentric lever 29 fitted over the eccentric cam 28 is connected to the swing lever 25. The swing lever 25 is swingable around the pivot shaft 24. Accordingly, the eccentric lever 29 moves vertically as the main shaft 27 rotates and the vertical movement is transmitted to the vertically movable segment 22 via the swing lever 25, link 26, and driving member 23.

At the vertically movable segment 22, there is provided a pair of engaging projections 22*a* and 22*b* which engage with the linking pin 19*a* at its top and bottom. When the engaging projections 22*a* and 22*b* are engaged with any one of the linking pins 19*a*, vertical movement of the vertically movable segment 22 is transmitted to the corresponding needle bar 19 and needle 11. In addition, at the upper portion of the vertically movable segment 22, a spring receiving member 35 is vertically movably seated around the master needle bar 21. The vertically movable segment 22 is rotationally urged by a coil spring 36, which is provided between the spring receiving member 35 and the vertically movable segment 22, to the linking position shown by a solid line in FIGS. 2 and 3. In other words, the engaging projections 22*a* and 22*b* are urged around the master needle bar 21 so as to face the needle bar 19 and engage with the linking pin 19A.

As shown in FIG. 2, the needle bars 19 are vertically movably supported by support frames 12A and 12B of the needle bar case 12. A compression spring 40 is put around each needle bar 19 and between the lower support frame 12*b* and each linking pin 19*a*. Each needle bar 19 is urged upward by a biasing force of each compression spring 40.

A directly driven needle bar jumping solenoid 41 is provided on the left wall of each head frame 50, and a swing lever 43, which is L-shaped in the plan view, is provided between the needle bar jumping solenoid 41 and the vertically movable segment 22. The swing lever 43 is horizontally swingably supported by a screw 44 inserted thereinto. One end of the swing lever 43 is connected to a plunger 41*a* of the needle bar jumping solenoid 41. An engaging portion 22D projects from the one side (the left side as viewed from an operator's position) of the engaging projection 22B beneath the vertically movable segment 22. An actuating rod 45 engageable with the engaging portion 22*d* projects downward from the other end of the swing lever 43. The actuating rod 45 is formed as a tube having a height in accordance with the vertically moving distance of the needle bar 19 in order to engage the engaging portion 22D wherever the needle bar 19 is positioned.

Therefore, when the needle bar jumping solenoid 41 is energized to project the plunger 41*a*, the swing lever 43 swings as shown by a two dotted chain line in FIG. 3 and the actuating rod 45 pushes against the engaging portion 22D. Accordingly, the vertically movable segment 22 swings around the master needle bar 21 to release the engaging projections 22A, 22B from the linking pin 19A. At this time, the driving force is stopped from being transmitted from the main shaft 27 to the needle bar 19. When the needle bar jumping solenoid 41 is no longer energized, the swing lever 43 swings back by the action of a tension spring 46 (FIG. 3) provided between the swing lever 43 and the head frame 50, as the actuating rod 45 retracts. Then, the vertically movable segment 22 is swung to the position shown by a solid line in FIG. 3 by the action of the coil spring 36, and the engaging projections 22A and 22B again engage with one of the linking pins 19A enabling the associated needle bar 19 to be vertically driven.

At the upper portion of each head frame 50, a swing plate 47 is swingably provided via a hinge 47A. The swing plate 47 is formed to be a flat plate which is generally perpendicular to the forward and backward direction of the embroidery machine and longer in the lateral direction. A plunger 48A of a needle bar stopping solenoid 48 is connected to the end opposite to the end where the hinge 47A is provided. The needle bar stopping solenoid 48 is also fixed to the head frame 50. As previously described, the engaging projections 22A and 22B engage with only one of the needle bars 19 according to the position of the needle bar case 12, enabling the appropriate needle bar 19 to be vertically moved. A rubber piece 49 is fixed to the front of the swing plate 47 so as to be opposite to the needle bar 19 being used.

Accordingly, when the needle bar stopping solenoid 48 is energized to project the plunger 48A, the swing plate 47 swings forward, as shown by a two dotted chain line in FIG. 3, to press the rubber piece 49 against the needle bar 19 in use. Thus, a braking force is applied to the needle bar 19. When the needle bar stopping solenoid 48 is no longer energized, the swing plate 47 retracts to disengage the rubber piece 49 from the needle bar 19, enabling the needle bar 19 to be vertically moved.

Figure 4:
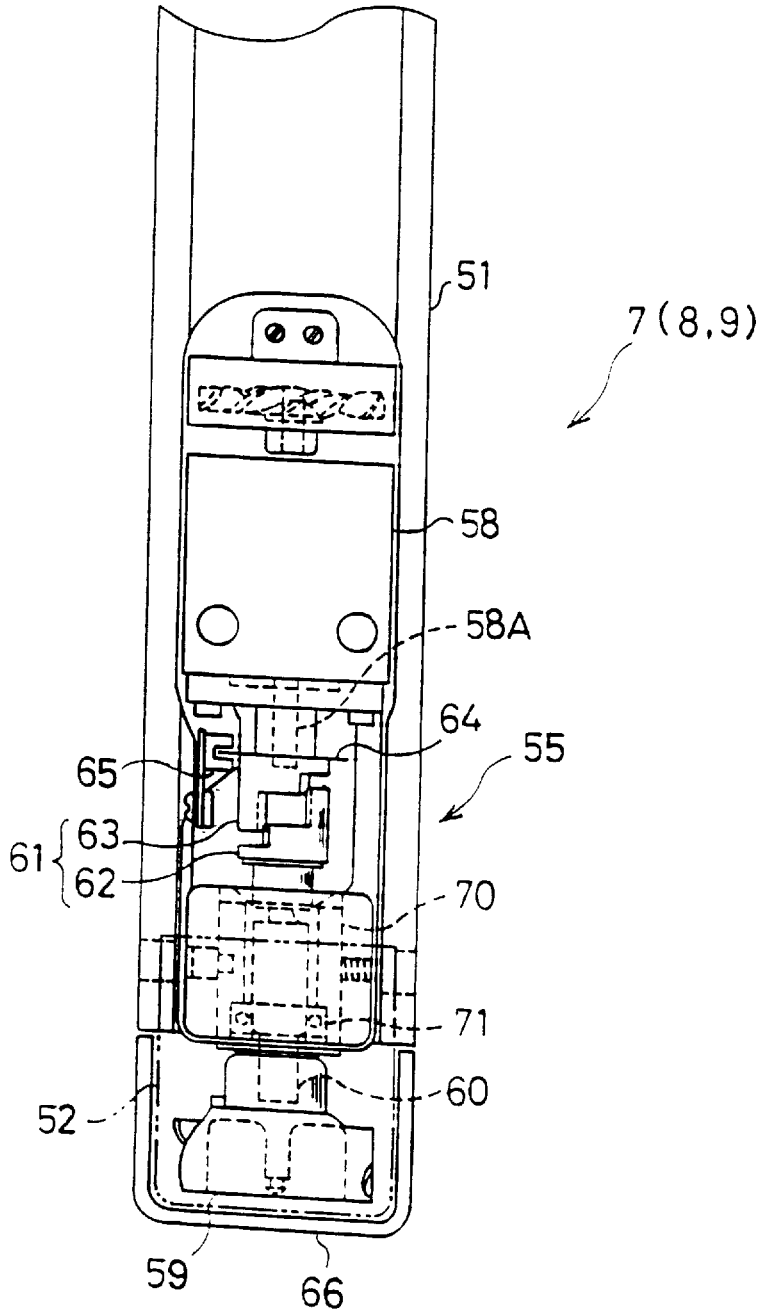
FIG. 4 is a plan view showing a structure of a bed of the embroidery machine.

Referring now to FIG. 4, described below is a structure of each of the beds 7, 8, 9. Since each of the beds 7, 8, 9 has the same structure, the bed 7 at the left end is described. The rear end of a bed case 51 which extends forward and backward and has a generally U-shaped section is attached to the support frame 3. The top front end of the bed case 51 is covered by a throat plate 52. A loop-catcher module 55 is detachably fixed to the front end of the bed case 51.

The loop-catcher module 55 comprises a loop-catcher drive motor 58 formed of a stepping motor and a loop catcher 59 provided directly under the vertically moving needle bar 19. A drive shaft 58A of the loop-catcher drive motor 58 and a loop-catcher shaft 60 fixed to the loop catcher 59 are connected via a coupling 61. The coupling 61 is a known coupling which interconnects a first linking member 62 attached to the rear end of the loop-catcher shaft 60 and a second linking member 63 attached to the drive shaft 58A. A disc encoder 64 is attached to the second linking member 63. A second encoder sensor 65, formed of a photosensor which optically detects a plurality of slits formed on the disc encoder 64, is provided on the side wall of the bed case 51. In addition, a bearing case 70 to which a bearing 71 is press-fitted is put around the loop-catcher shaft 60.

Figure 5:
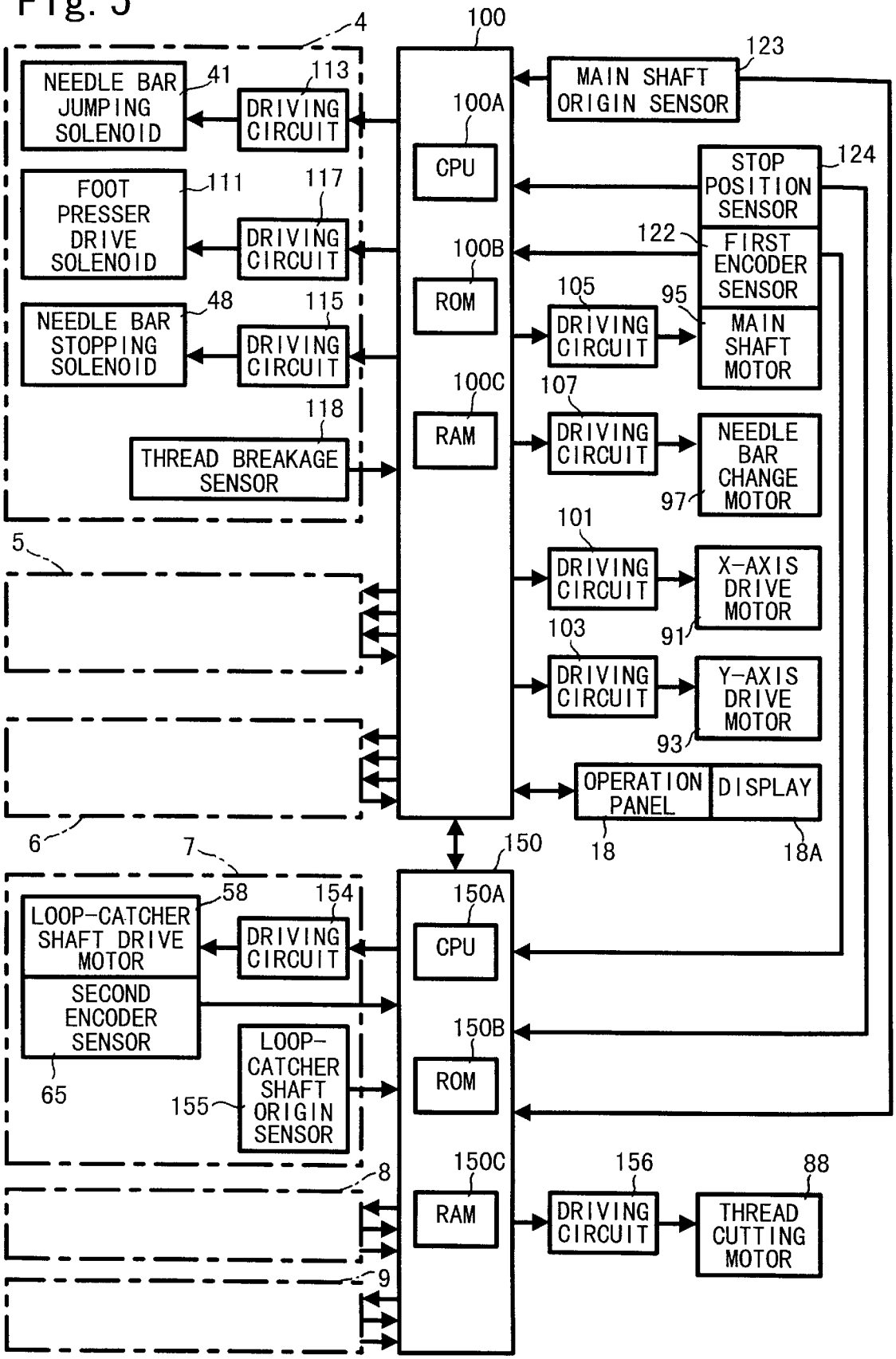
FIG. 5 is a block diagram showing a structure of a control system of the embroidery machine.

As shown in FIG. 5, built into the base frame 1 are an X-axis motor 91 and a Y-axis motor 93 which move the workpiece holding frame 16 in the X-axis and Y-axis directions, respectively, a main shaft motor 95 which drives the main shaft 27, and a needle bar change motor 97 which laterally moves the needle bar case 12. These motors 91, 93, 95, 97 are connected to an embroidery machine control circuit 100 which is also built into the base frame 1. Described below is a control system of the embroidery machine according to the invention.

The embroidery machine control circuit 100 is designed to control the embroidery machine entirely except for the loop catcher driving control, and is formed of a known microcomputer mainly comprising a central processing unit (CPU) 100A, a read only memory (ROM) 100B and a random access memory (RAM) 100C. The above-mentioned motors 91, 93, 95, 97 are connected to the embroidery machine control circuit 100 via driving circuits 101, 103, 105, 107, respectively, and the following devices are also connected thereto.

For the head 4, the above-mentioned needle bar jumping solenoid 41, needle bar stopping solenoid 48, and a presser foot drive solenoid 111 for vertically moving a presser foot 109 (FIG. 2) are connected to the embroidery machine control circuit 100 via the driving circuits 113, 115, 117, respectively, and a thread breakage sensor 118 for detecting a thread breakage in the head 4 is also connected thereto. For the heads 5, 6, these devices are connected in the same manner to the embroidery machine control circuit 100. For the main shaft motor 95, connected to the embroidery machine control circuit 100 are a first encoder sensor 122 which outputs 1000 slit signals per rotation of the main shaft motor 95, a main shaft origin sensor 123 which outputs one main shaft origin signal per 1000 slit signals of the first encoder sensor 122, i.e., one rotation of the main shaft motor 95, and a stop position sensor 124 which detects the stop position of the needle bar 19 (the position attained when the main shaft 27 rotates approximately 100° from its upper dead point).

In addition, a loop-catcher shaft control circuit 150, which performs driving control and thread cutting control of the loop catcher 59, is connected to the embroidery machine control circuit 100. The loop-catcher shaft control circuit 150 is formed of a microcomputer mainly comprising a CPU 150A, ROM 150B, and RAM 150C. For the bed 7, the loop-catcher drive motor 58 is connected to the loop-catcher shaft control circuit 150 via a driving circuit 154. Also connected thereto are the above-mentioned second encoder sensor 65 which outputs 50 slit signals per rotation of the disc encoder 64 and a loop-catcher shaft origin sensor 155 which outputs one loop-catcher shaft synchronizing signal per rotation of the disc encoder 64. For the beds 8, 9, they are connected in the same manner to the loop-catcher shaft control circuit 150. In addition, a thread cutting motor 88, which drives a thread cutter (not shown) to cut a needle thread, is connected to the loop-catcher shaft control circuit 150 via a driving circuit 156. The above-mentioned first encoder sensor 122, main shaft origin sensor 123, and stop position sensor 124 are also connected thereto.

Figure 6:
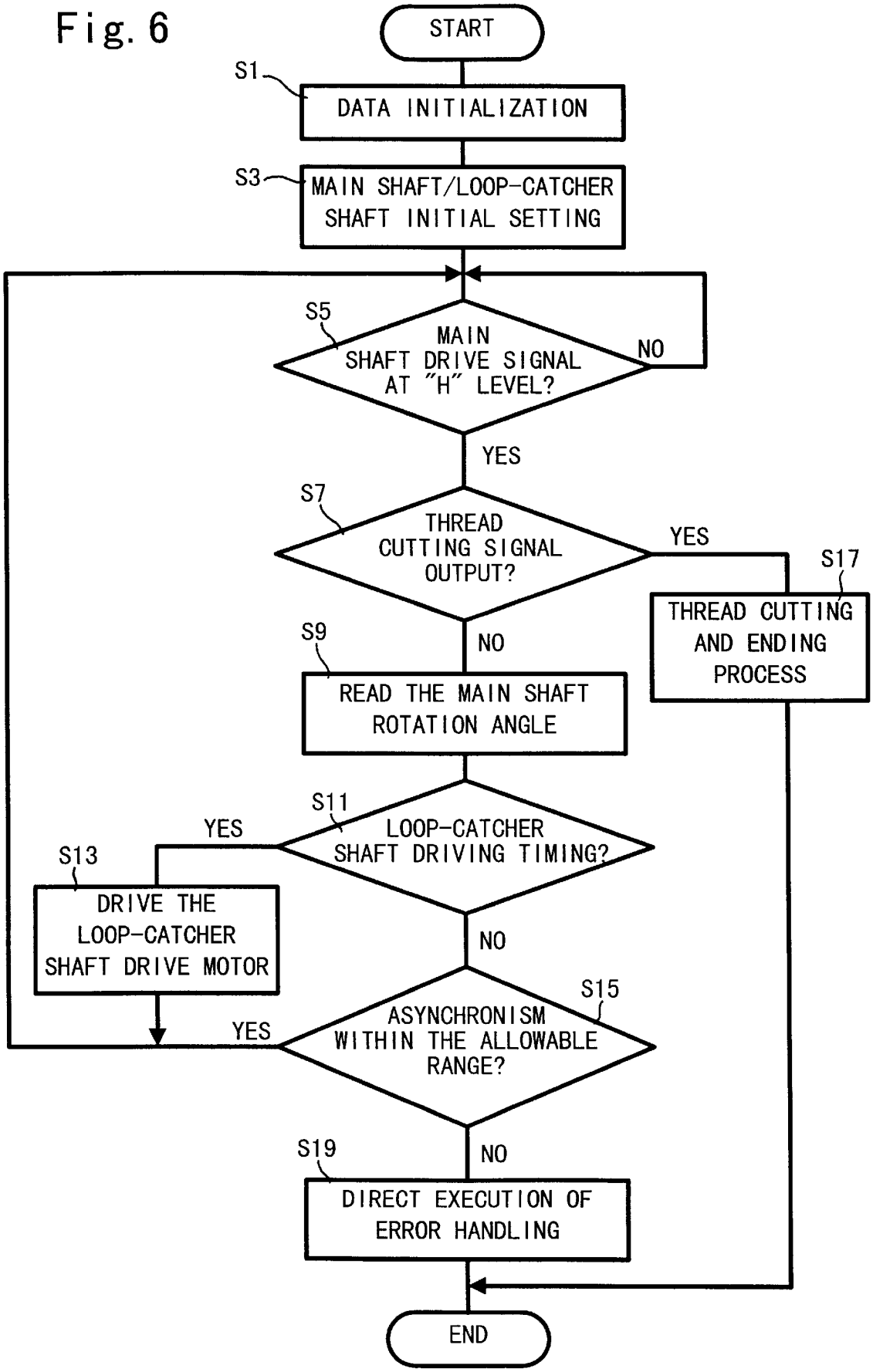
FIG. 6 is a flowchart showing loop-catcher shaft driving control executed by the control system.

Referring now to the flowchart of FIG. 6, a routine for loop-catcher shaft driving control executed by the loop-catcher shaft control circuit 150 is described. Prior to discussing the control, the signals output from the embroidery machine control circuit 100 to the loop-catcher shaft control circuit 150 are described. When sewing is started, the main shaft 27 is stopped at the above-mentioned stop position while the needle bar 19 is disengaged from the vertically movable segment 22 and positioned at its upper dead point. When sewing is executed according to the embroidery data containing stitch position data for N stitches, the embroidery machine control circuit 100 starts driving the main shaft motor 95 while outputting a main shaft driving signal at a "H" level. When sewing for N stitches is completed, the embroidery machine control circuit 100 changes the main shaft driving signal to a "L" level, stops the main shaft 27 at the above-mentioned stop position, and outputs a thread cutting signal.

The loop-catcher shaft control circuit 150 starts the loop-catcher shaft driving control when power is turned on. First, in S1 (hereinafter, S stands for a step), various data is initialized. Here, timers and counters to be used for the control are reset. Subsequently, in S3, main shaft/loop-catcher shaft initial setting is executed. Here, the loop-catcher shaft drive motor 58 is driven to position the loop-catcher shaft 60 to its origin where the loop-catcher shaft synchronizing signal is output from the loop-catcher shaft origin sensor 155. The loop-catcher drive motor 58 is not driven until the main shaft 27 is judged to be at its stop position by the stop position sensor 24. When the main shaft 27 is not at its stop position, the embroidery machine control circuit 100 displays an error message on the display 18A to prompt the operator to manually rotate the main shaft 27 to its stop position.

When the main shaft 27 has been positioned at its stop position and the loop-catcher shaft 60 has been positioned at the above-mentioned origin (S3), the loop-catcher shaft control circuit 150 judges, in S5, whether the main shaft driving signal output from the embroidery machine control circuit 100 is at the "H" level. When it is at the "L" level (NO), control loops at that point until the "H" level is recognized. When it is at the "H" level (YES), S7 is reached, where whether the embroidery machine control circuit 100 has output the thread cutting signal is determined. When no thread cutting signal has been output (NO), S9 is reached, where the rotation angle of the main shaft 27 is read. In S11, the control circuit 150 judges whether it is time to drive the loop-catcher shaft 60 according to the rotation angle. If it is so (S11: YES), the loop-catcher drive motor 58 is driven to rotate by one step (S13) and control returns to S5.

If it is not time for loop-catcher shaft 60 driving (S11: NO), S15 is reached, where the control circuit 150 judges whether asynchronism between the main shaft 27 and the loop-catcher shaft 60 is within the allowable range in comparison between the number of driving pulses output so far to the loop-catcher drive motor 58 and the rotation angle read in S9. When they are asynchronous with each other within the allowable range (S15: YES), control returns to S5 and the above-mentioned steps are repeated. When S5 to S15 are repeated, stitches are formed on the material being sewn by the needle 11 and the loop catcher 59 which operate in cooperation with each other. When the embroidery machine control circuit 100 outputs the thread cutting signal upon the completion of sewing for N stitches, the determination in S7 is YES and S17 is reached. In S17, the loop-catcher shaft control circuit 150 rotates the loop-catcher shaft 60 by a predetermined angle to reserve the remaining needle thread and drives the thread cutting motor 88 to execute needle thread cutting and ending process, and the routine comes to an end.

Described above is the routine executed by the loop-catcher shaft control circuit 150 during normal sewing. If the main shaft 27 and the loop-catcher shaft 60 become asynchronous excessively for some reason, the determination in S15 is NO and S19 is reached. In S19, the embroidery machine control circuit 100 is directed to execute error handling and the routine comes to an end. When the routine ends in this way, the loop-catcher shaft control circuit 150 also executes the process for stopping the loop-catcher drive motor 58.

Referring now to the flowchart of FIG. 7, described below is error handling executed by the embroidery machine control circuit 100. When error handling is started, the needle bar jumping solenoid 41 is driven for a predetermined period in S21. Then, the vertically movable segment 22 is disengaged from the linking pin 19A, as described before, and the driving force is stopped from being transmitted to the needle bar 19. In S23, the rotation angle of the main shaft 27 is read via the above-mentioned first encoder sensor 122 and main shaft origin sensor 123. Subsequently, in S25, the embroidery machine control circuit 100 determines whether the above-mentioned disengagement timing determined by S21 is provided when the needle bar 19 is descending.

Figure 8:
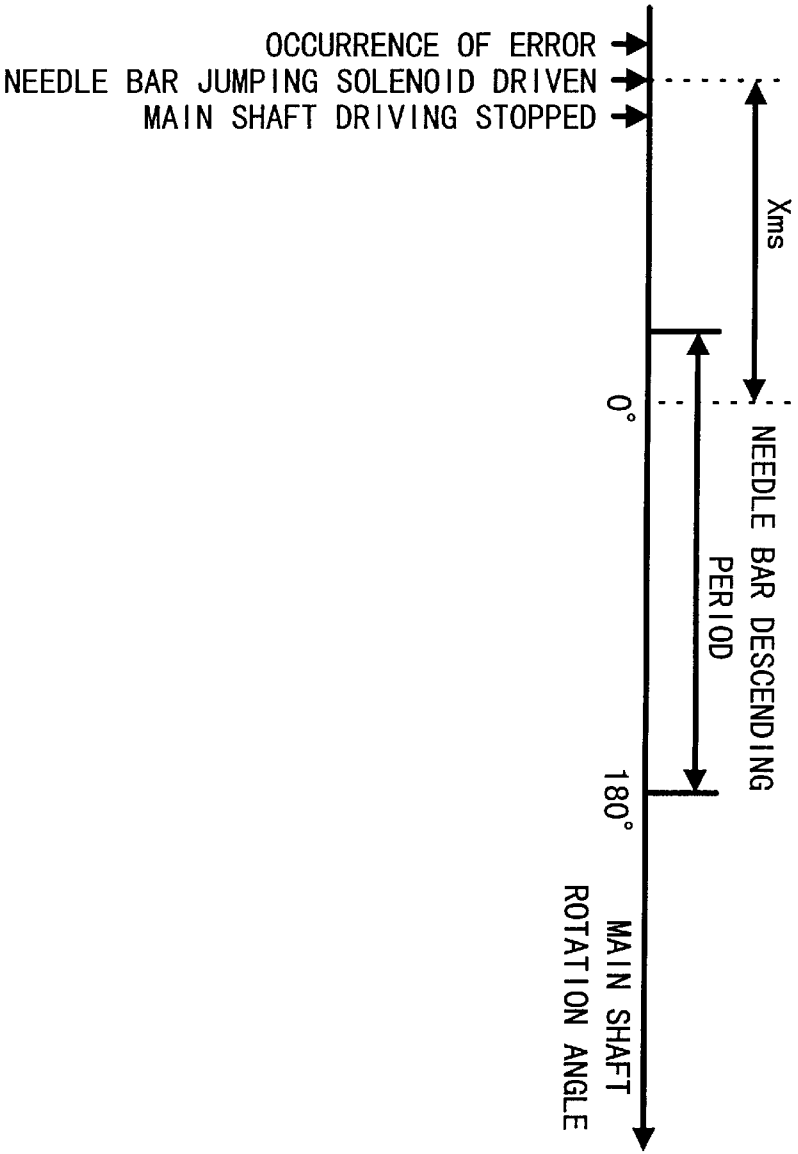
FIG. 8 is an illustrative diagram showing the principle of judgment of the needle bar descending period in the error handling.

As shown in FIG. 8, when erroneous asynchronism occurs (S15: NO), the needle bar jumping solenoid 41 is driven (S21). There is a delay (X ms) between output of the driving signal and the actual disengagement. This delay mainly results from the operating time of the needle bar jumping solenoid 41. When the main shaft 27 stopping process is executed in S29, which will be described later, after the driving signal is output in S21, the main shaft 27 decelerates abruptly to a stop; however it rotates by a certain degree. Because of this, the control circuit 100 predicts, in S25, whether the disengagement timing after the elapse of the above-mentioned delay (X ms) occurs during descent of the needle bar 19.

When judgment is YES in S25, control proceeds to S27, where the needle bar stopping solenoid 48 is driven. Then, the rubber piece 49 is pressed against the needle bar 19 as described before and a braking force is transmitted to the needle bar 19. When judgment is NO in S25 or after S27, control proceeds to S29 where a main shaft stop command is issued to the driving circuit 105. Then, the main shaft motor 95 is stopped immediately.

Subsequently, an error message is displayed on the display 18A in S33, and control waits for the error to be removed in S35. When the operator removes the error by operating, for example, the error reset switch on the operation panel 18 (S35: YES), the error handling routine comes to an end. Then, various controls including the loop catcher driving control shown in FIG. 6, can be restarted.

As described above, when the main shaft 27 and the loop-catcher shaft 60 becomes asynchronous beyond the allowable range (S15: NO) in the embroidery machine, the driving force of the main shaft 27 is prohibited from being transmitted to the needle bar 19 (S21), and a braking force is applied to the needle bar 19 by means of the rubber piece 49 (S27). Accordingly, the needle bar 19 can be stopped reliably, and the needle 11 can be effectively prevented from interfering with the loop catcher 59. Furthermore, since the braking force is applied to the needle bar 19 (S27) only when it is descending (S25: YES), there is no chance that braking prevents the needle bar 19 from ascending. Therefore, interference between the needle bar 19 and the rotary shaft 59 is prevented more effectively.

In the above preferred embodiment, the needle bar jumping solenoid 41, swing lever 43, and step S21 by the embroidery machine control circuit 100 correspond to a transmission prohibiting unit; the needle bar stopping solenoid 48, swing plate 47, rubber piece 49, and step S27 by the embroidery machine control circuit 100 correspond to a braking unit; the first encoder sensor 122, main shaft origin sensor 123, and step S25 by the embroidery machine control circuit 100 correspond to a moving direction detector; and the first encoder sensor 122, main shaft origin sensor 123, loop-catcher shaft origin sensor 155, and step S15 by the loop-catcher shaft control circuit 150 correspond to asynchronism detector.

The invention is not restricted to the particular forms in the foregoing embodiment and various modifications and alternations can be made thereto without departing from the scope of the invention. For example, an alternate structure for applying a braking force to the needle bar 19 is conceivable besides the one described above, in which the needle bar 19 is attracted by an electromagnet or in which braking is achieved by a biasing force of a high-compression spring provided separately from the compression spring 40 and actuated only during error handling. However, when a braking force is applied by pressing the rubber piece 49 (or an alternate member having a high friction coefficient, such as animal leather) against the needle bar 19, as described before, the needle bar 19 can be braked quite reliably with a simple structure. Consequently, the needle bar 19 can be stopped more reliably. Simultaneously the embroidery machine is simplified and the production cost is reduced.

Figure 7:
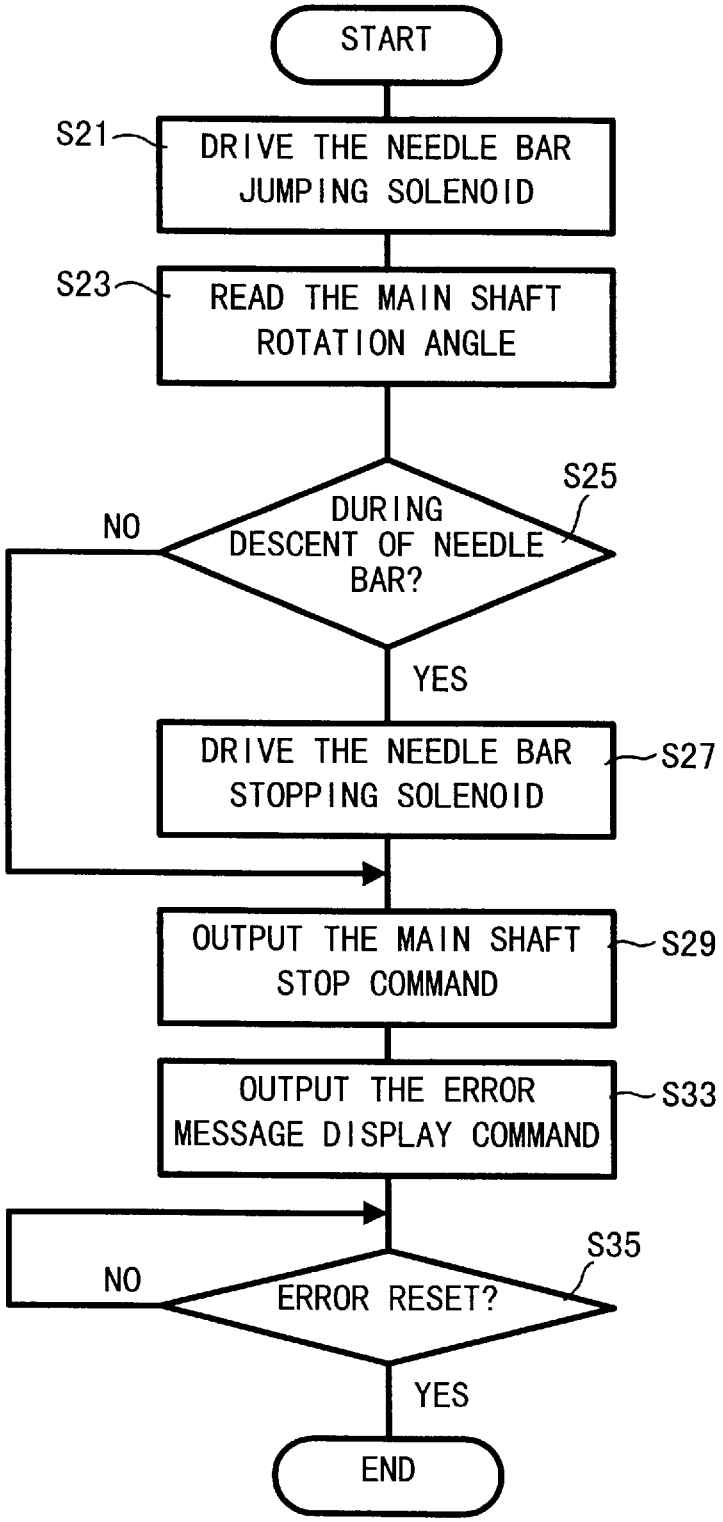
FIG. 7 is a flowchart showing error handling executed by the control system.

In addition, the needle bar 19 stopping control, shown in the flowchart in FIG. 7, may be executed when color change or skip stitch (needle bar jump) is executed, or when a thread breakage occurs. In this case, the needle bar 19 can be effectively prevented from being caught in and/or from forming excessive holes in the material being sewn 99. Moreover, the invention can be applied to various sewing machines, besides embroidery machines, such as those where a main shaft motor and a loop-catcher shaft are connected by means of, for example, a belt. The angle at which a braking force is applied to the needle bar 19 may be set in the range free from interference with the loop catcher 59 within the needle bar 19 descending travel.

What is claimed is:

1. A needle bar stopper for use in a sewing machine having a main shaft and a needle bar which moves vertically upon reception of a driving force from the main shaft, the needle bar stopper for stopping the needle bar comprising:

a transmission prohibiting unit which prohibits transmission of the driving force from the main shaft to the needle bar; and a braking unit which applies a braking force to the needle bar when transmission of the driving force from the main shaft to the needle bar is prohibited, wherein the needle bar stopper further comprises a moving direction detector which detects the needle bar moving direction, and the braking unit is controlled to operate based on a result of detection by the moving direction detector.

2. The needle bar stopper for use in a sewing machine as claimed in claim 1, wherein the braking unit applies a braking force by pressing a member having a high friction coefficient against the needle bar.

3. The needle bar stopper for use in a sewing machine that further includes a main shaft motor which rotationally drives the main shaft and a separate loop-catcher drive motor which rotationally drives a loop catcher as claimed in claim 1, further comprising an asynchronism detector which detects asynchronism between the needle bar and the loop catcher; and the transmission prohibiting unit prohibits transmission of the driving force when asynchronism detected by the asynchronism detector exceeds a predetermined threshold value.

4. The needle bar stopper for use in a sewing machine as claimed in claim 1, wherein the braking unit applies a braking force to the needle bar when the moving direction detector detects the needle bar moving downward.

5. The needle bar stopper for use in a sewing machine as claimed in claim 2, wherein the braking unit is formed of a solenoid which presses the member having a high friction coefficient against the needle bar.

6. The needle bar stopper for use in a sewing machine as claimed in claim 2, wherein the member having a high friction coefficient is formed of a polymeric member.

7. The needle bar stopper for use in a sewing machine as claimed in claim 1, further comprising a needle bar jumping solenoid.

8. A needle bar stopping mechanism for use in a sewing machine having a loop catcher, the needle bar stopping mechanism comprising:

a needle bar having a linking pin;

a needle bar drive mechanism having an engaging portion for selectively engaging the linking pin;

a needle bar braking mechanism for applying a braking force to the needle bar;

a synchronization detector for detecting asynchronous behavior between operation of the needle bar and the loop catcher; and a needle bar direction of movement sensor for determining a direction of movement of the needle bar.

9. The needle bar stopping mechanism as claimed in claim 8, wherein the needle bar drive mechanism comprises:

a rotatable drive shaft;

an eccentric cam fixed to the drive shaft;

an eccentric lever having an annular part rotatably received on the eccentric cam and a lever part; and a linkage between an end of the lever part of the eccentric lever and the engaging part, the engaging part driving the linking pin when selectively engaged causing the needle to reciprocatively move in the vertical direction.

10. The needle bar stopping mechanism as claimed in claim 8, wherein the engaging portion has a contact member, and further comprises a disengagement mechanism for causing the selective engagement of the engaging portion of the needle bar drive mechanism with the linking pin.

11. The needle bar stopping mechanism as claimed in claim 10, wherein the disengagement mechanism comprises:

a needle bar jumping solenoid having an engagement rod;

a swing lever having a substantially L-shape when viewed in plan, one leg of the swing lever in contact with the engagement rod of the needle bar jumping solenoid;

an actuating rod extending from an end of the other leg of the swing lever to contact the contact member of the engaging portion; and a force generating device for maintaining the one leg of the swing lever in contact with the engagement rod of the needle bar jumping solenoid.

12. The needle bar stopping mechanism as claimed in claim 11, wherein the needle bar braking mechanism comprises:

a needle bar stopping solenoid having a plunger;

a swing plate rotatably mounted at one end to the sewing machine and contacting the plunger at the other end; and a brake means mounted to a surface of the swing plate for engaging the needle bar.

13. The needle bar stopping mechanism as claimed in claim 12, wherein the brake means is a pad for frictionally engaging the needle bar.

14. The needle bar stopping mechanism as claimed in claim 13, wherein the pad is a polymeric material.

15. The needle bar stopping mechanism as claimed in claim 8, further comprising a control unit, the control unit determining, based upon a signal from the synchronization detector, when the asynchronous behavior of the needle bar and the loop catcher is outside an allowable range for initiating error handling.

16. The needle bar stopping mechanism as claimed in claim 15, wherein during error handling, the control unit stops operation of the loop catcher and initiates stopping of the needle bar.

17. The needle bar stopping mechanism as claimed in claim 16, wherein the control unit determines whether the needle bar is descending based on a signal from the needle bar direction of movement sensor and, when the needle bar is descending during error handling, activates the needle bar braking mechanism to stop the needle bar.

18. A needle bar stopper for use in a sewing machine having a main shaft and a needle bar which moves vertically upon reception of a driving force from the main shaft, the needle bar stopper for stopping the needle bar comprising:

transmission prohibiting means for probiting transmission of the driving force from the main shaft to the needle bar; and braking means for applying a braking force to the needle bar when transmission of the driving force from the main shaft to the needle bar is prohibited, wherein the braking means has a member having a high coefficient of friction that is pressed against the needle bar to apply a braking force.

* * * * *